US005154523A

United States Patent [19]

Devreeze

[11] Patent Number: 5,154,523

[45] Date of Patent: Oct. 13, 1992

[54] BRUSH HAVING INTEGRALLY CONNECTED LIQUID CHAMBER

[76] Inventor: Jozef J. Devreeze, Borgerspark 13, 9642 LK Veendam, Netherlands

[21] Appl. No.: 477,796

[22] Filed: Feb. 9, 1990

Related U.S. Application Data

[63] Continuation-in-part of Ser. No. 172,619, Mar. 24, 1988, abandoned.

[30] Foreign Application Priority Data

Mar. 25, 1987 [NL] Netherlands ..... 8700697

[51] Int. Cl.[5] ..... A46B 11/02

[52] U.S. Cl. ..... 401/144; 401/145; 401/153; 401/169; 401/180; 401/286; 401/278

[58] Field of Search ..... 401/101, 117, 136, 144, 401/145, 153, 169, 180, 183, 186, 272, 273, 189, 268, 269, 280, 285, 286, 210, 170, 203, 282, 284, 36, 278

[56] References Cited

U.S. PATENT DOCUMENTS

| | | | |
|---|---|---|---|
| 103,640 | 5/1870 | Merritt | 401/180 X |
| 756,103 | 3/1904 | Doten | 401/272 |
| 825,448 | 7/1906 | Farron | 401/186 |
| 938,362 | 10/1909 | Anderson | 401/180 |
| 1,006,641 | 10/1911 | Fesler | 401/101 |
| 1,065,879 | 6/1913 | Krebs | 401/117 X |
| 1,258,677 | 3/1918 | Haskell | 401/180 X |
| 1,505,442 | 8/1924 | Stephens | 401/186 X |
| 2,425,474 | 8/1947 | Hussey | 401/180 |
| 2,534,589 | 12/1950 | Gebien | 401/180 X |
| 2,625,302 | 1/1953 | Mahoney | 401/180 X |
| 2,652,949 | 9/1953 | Martin | 401/152 X |
| 2,753,846 | 7/1956 | Miessner | 401/186 |
| 3,049,745 | 8/1962 | Lambers | 401/153 |
| 3,256,550 | 6/1966 | Laxalt | 401/176 X |
| 4,252,455 | 2/1981 | de la Pena | 401/144 X |
| 4,350,458 | 9/1982 | Murahara et al. | 401/153 X |
| 4,640,637 | 2/1987 | Winthrop | 401/183 X |
| 4,913,175 | 4/1990 | Yokosuka et al. | 401/273 X |
| 4,944,625 | 7/1990 | Futter et al. | 401/153 |

FOREIGN PATENT DOCUMENTS

| | | | |
|---|---|---|---|
| 468127 | 9/1950 | Canada | 401/180 |
| 1004675 | 4/1952 | France | 401/153 |

*Primary Examiner*—Danton D. DeMille
*Attorney, Agent, or Firm*—McDermott, Will & Emery

[57] ABSTRACT

A brush having a bundle of bristles connected to a handle and being provided with a chamber to be filled with a liquid material is disclosed. The chamber includes pressurizing means for maintaining the liquid material under continuous pressure and closure means for preventing the liquid material from flowing from the chamber to the bristles. The chamber is also integrally connected with the brush and is connected to the bundle of bristles in a liquid-conductive relationship by means of a tubular conduit. The bundle of bristles is set into a separate head mounted for sliding movement on the handle, thereby rendering the conduit and bundle axially slidable relative to each other between a first use position and a second filling position.

4 Claims, 5 Drawing Sheets

BRUSH HAVING INTEGRALLY CONNECTED LIQUID CHAMBER

CROSS-REFERENCE TO RELATED APPLICATION

This application is a continuation-in-part of U.S. patent application Ser. No. 172,619 filed Mar. 24, 1988now abandoned.

BACKGROUND OF THE INVENTION

This invention relates to a brush comprising a bundle of bristles connected to a handle.

Such a brush is known for many application purposes, e.g. for application as a paint brush.

A brush for painters is naturally a generally known tool. One property of paint brushes is that they have only a limited capacity to hold paint between the bristles of the bundle. During painting, the brush will have to be dipped again and again at a relatively high frequency into the paint, which is present in a separate container. This forces the painter to keep the paint container within reach and, practically speaking, to carry it continuously in one hand during painting. As the other hand is necessary for handling the paint brush, the painter has thus both hands occupied during the work.

SUMMARY OF THE INVENTION

It is an object of the present invention to provide a brush, e.g., a paint brush, such that the painter's actions during painting are simpler, he does not have two hands continuously occupied and clean, drip-free and safe painting is promoted.

According to the present invention, a brush of the above-described type is characterized in that it is provided with a chamber to be filled with liquid material, means for filling the chamber, pressurizing means for maintaining said liquid material in said chamber under continuous pressure and closure means for preventing said liquid material from flowing from the chamber to said bristles, said chamber being integrally connected with the brush and being connected to said bundle of bristles in liquid-conductive relationship be means of a tubular conduit. The bundle of bristles is set into a separate head mounted for sliding movement on said handle, thereby rendering said conduit and said bundle slidable relative to each other between a first use position in which an end of said conduit remote from said chamber is situated within said bundle of bristles, and the position of said head relative to said bundle is fixable by detent means, and a second filling position, in which the end of said conduit remote from said chamber extends beyond the bundle of said bristles.

BRIEF DESCRIPTION OF THE DRAWINGS

Some embodiments of a brush according to the present invention will now be described, by way of example, with reference to the accompanying diagrammatic drawings, in which identical reference numerals in the different figures relate to members having analogous functions, and in which drawings:

FIGS. 1, 2 and 3 diagrammatically illustrate an embodiment of one and the same brush according to this invention in different situations.

DESCRIPTION OF THE PREFERRED EMBODIMENTS

Figure 1:
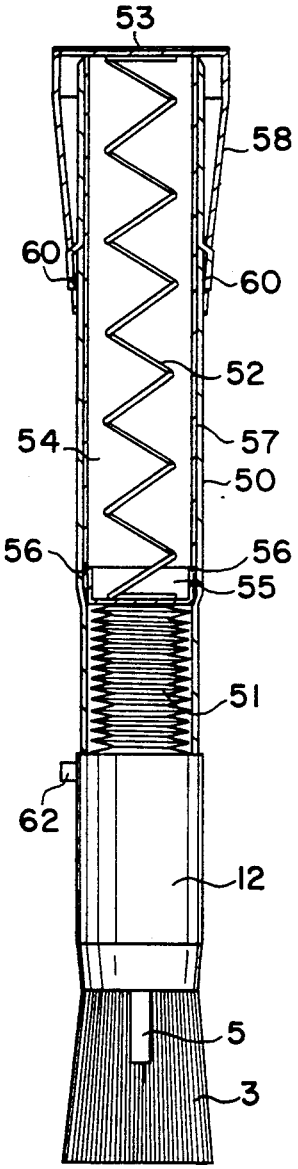
FIGS. 1–3 illustrate the construction and operation of a first embodiment of a brush according to the present invention.
Figure 2:
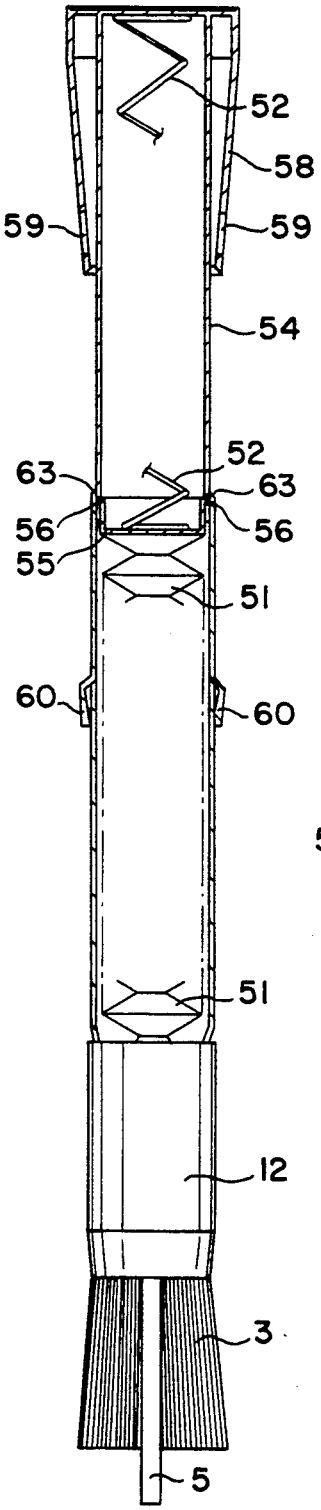
Figure 2A:
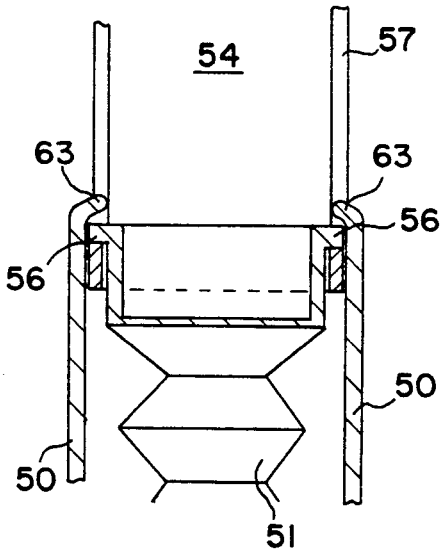
Figure 2C:
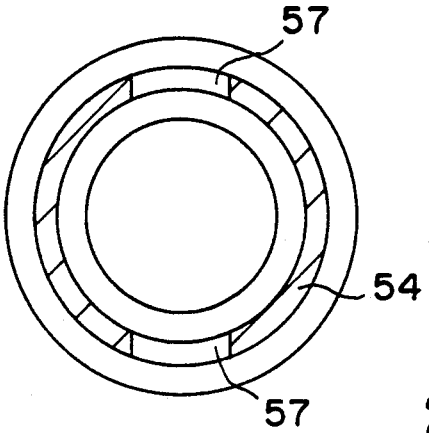
Figure 2B:
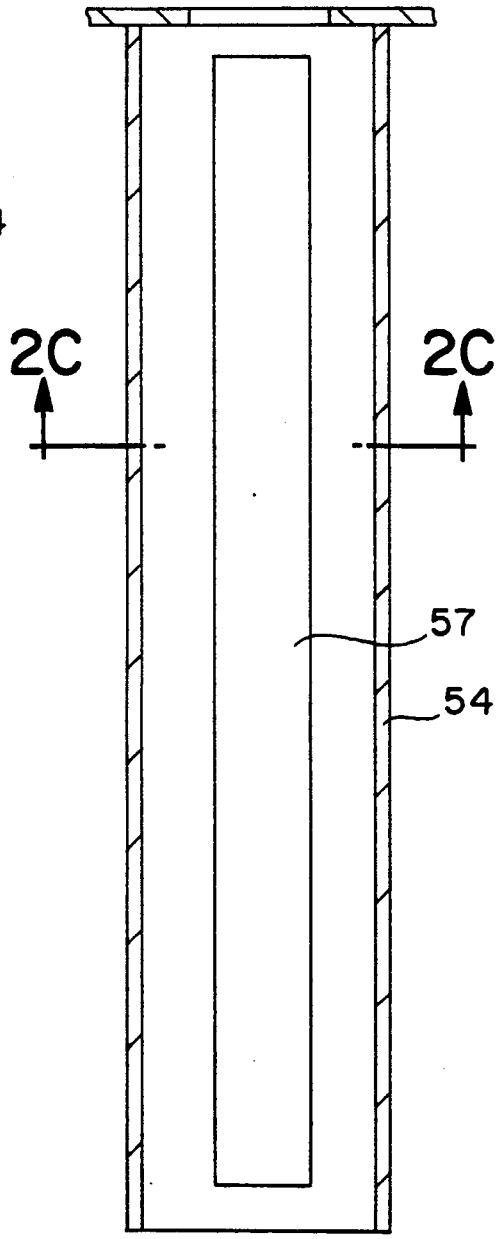
Figure 3:
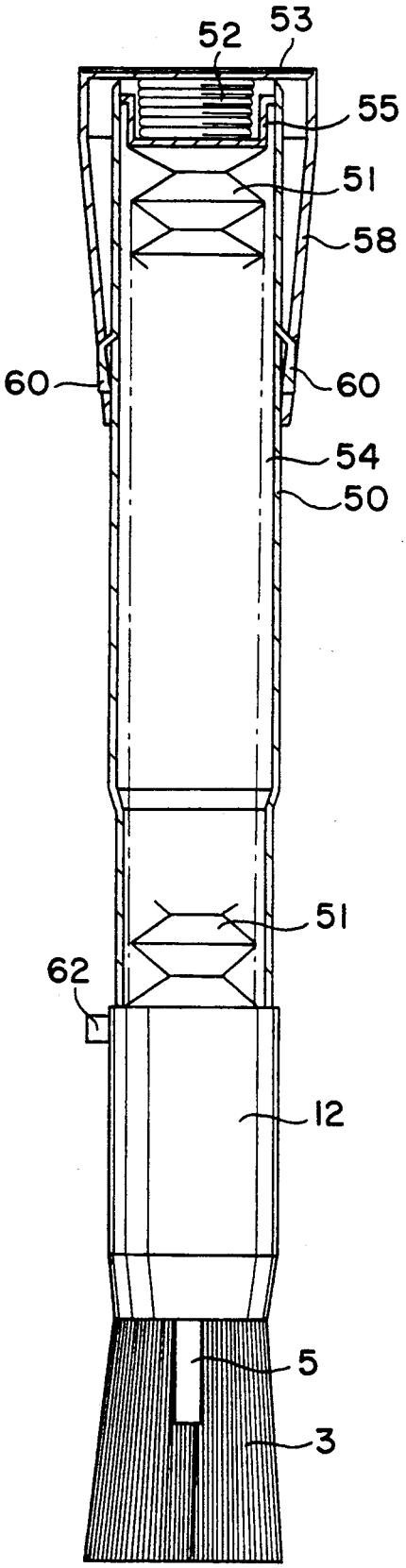
Figure 6:
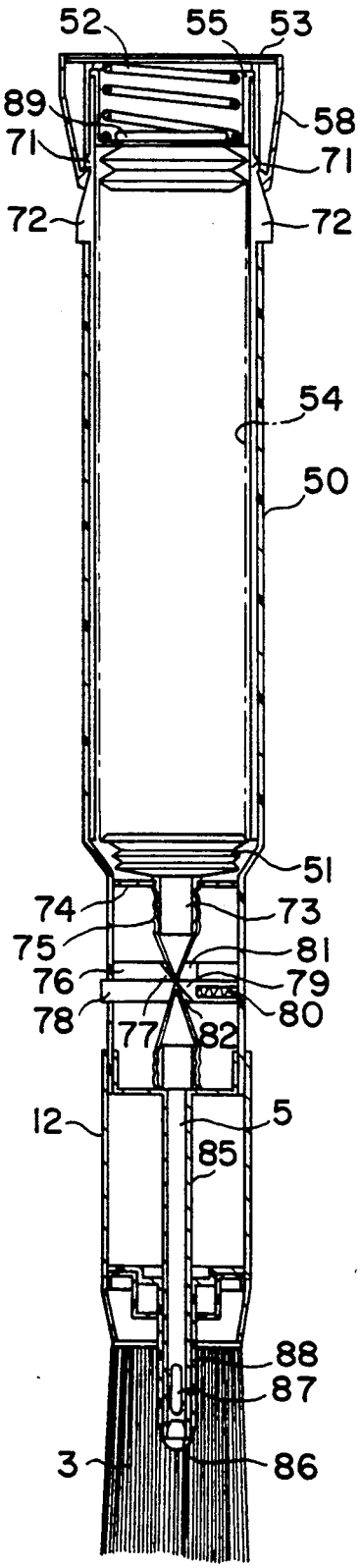

The brush shown in FIGS. 1–3 comprises a head 12 having bristles 3 and a conduit 5 connected to a reservoir 51 and extending into the bristles. Head 12 is mounted for sliding movement on the corresponding end of a substantially cylindrical hollow handle 50 which contains the reservoir 51 formed, in the example shown, by a bellows, which in the situation shown in FIG. 1, is compressed entirely or substantially entirely. Bellows 51 is compressed by a spring 52 placed intermediate the end of the bellows remote from bristles 3 and a cover 53 of the hollow handle. Cover 53 is attached to an inner sleeve 54 extending in handle 50, said inner sleeve being of sufficient width to accommodate the bellows. The top end of the bellows is fixed in a member 55, which may be disc-shaped, but is cup-shaped in this example, serving as a support for spring 52. To that end, the bellows may be provided with an undercut transverse rib 89 on the top surface, which rib is inserted into a slot in the bottom of member 55 (FIG. 6). Member 55 can be moved upwards from the position shown in FIG. 1, in a manner to be described hereinafter, within the inner sleeve. At the lower end, however, member 55 cannot be pulled out of the inner sleeve. This is effected by providing the cup-shaped member with radial projections 56, which fall into longitudinal slots 57 of the inner sleeve. The longitudinal slots, however, are closed at the lower end of the inner sleeve.

Figure 4:
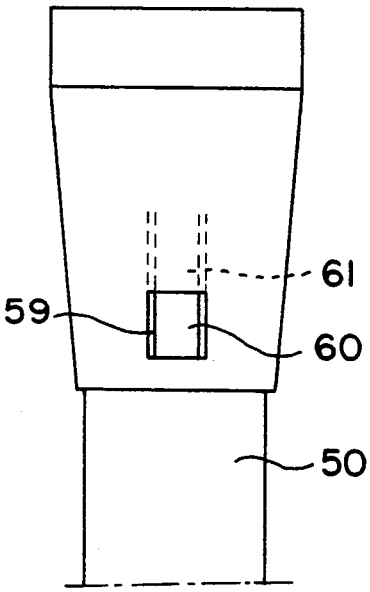
FIG. 4 is a detail view of an embodiment.

Cover 53 is attached to the inner sleeve 54 but engages with a skirt 58 around the hollow handle 50. Skirt 58 is provided near the free edge with means cooperating with means formed on sleeve 50 for retaining skirt 58. In the embodiment shown, the skirt is provided for that purpose with at least one window 59 (FIG. 2) into which at least one resilient projection 60 of the hollow handle can catch. Projections 60 advantageously form part of tongue-shaped members 61, cut out from the wall of the outer sleeve, as diagrammatically shown in FIG. 4.

Figure 5:
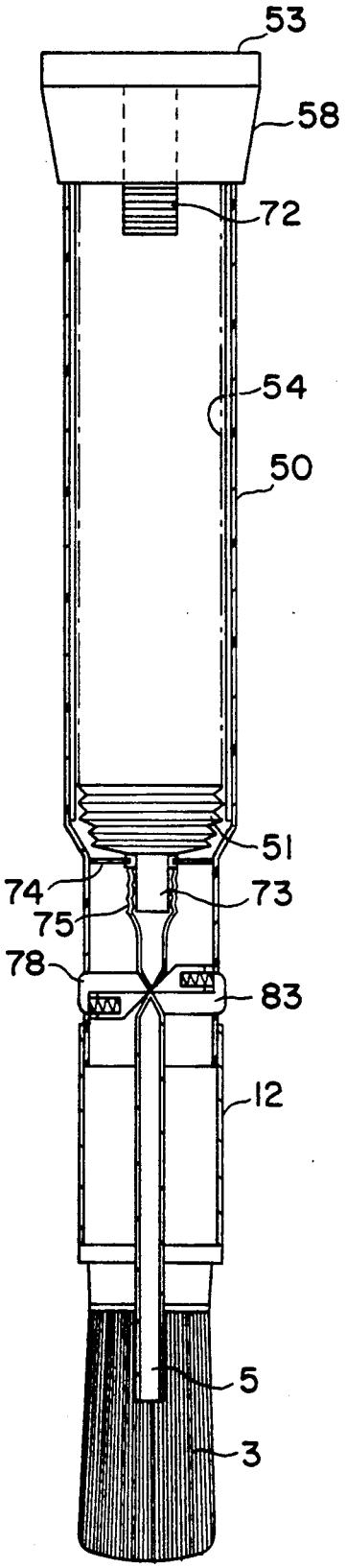
FIGS. 5, 6 illustrate another embodiment of a brush according to the present invention.

It is observed that skirt 58 could alternatively be provided with an internal shoulder falling behind corresponding projections of resilient tongue-shaped members of the outer sleeve. The tongue-shaped members should then extend beyond the edge of skirt 58 to enable manual operation. This is shown in FIG. 5 and FIG. 6.

In example shown, head 12 is locked in the normal operating position by a resilient projection 62, adapted to be depressed against spring pressure, and which falls into a windowlike cut-out in the wall of head 12. It is observed that head 12 could alternatively be locked differently, e.g., in the manner already indicated for the skirt of cover 53.

As will be explained in more detail hereinafter, conduit 5 is shut off in the position shown in FIGS. 1 and 3, while conduit 5 in this embodiment is open when projection 62 is depressed.

The operation of the brush shown in FIGS. 1-3 is as follows. In the position shown in FIG. 1, the bellows-shaped reservoir 51 is empty or substantially empty. To fill the reservoir, first the end of conduit 5 is released. For that purpose, conduit 5 is opened, in this embodiment by depressing projection 62, and subsequently head 12 is pushed upwards into the position shown in FIG. 2. The free end of conduit 5 is then placed, e.g., in a supply of paint, stain or the like. Subsequently, the lock of cover 53 is released in the manner already described and cover 53 is pulled upwards. The cover thereby takes along inner sleeve 54, which in turn extends the bellows by means of member 55. Member 55, and hence the bellows, cannot be pulled out of the hollow handle because inwardly extending projection 63, near the end of the outer sleeve, retains the radial projections 56 of member 55. During the extension of the bellows, the latter is filled with the material in which conduit 5 is placed. Spring 52 is still in an expanded state, as shown in FIG. 2.

From the configuration shown in FIG. 2, the brush is brought into the position of use by first pushing the head downwards again, so that the end of conduit 5 is again located within the bristles. When the correct position is reached, projection 62 slips outwardly through the corresponding window of the head, thereby locking the head and, in this embodiment, also shutting off conduit 5.

Subsequently, cover 53 is again pressed onto the outer sleeve. The inner sleeve 54 is then pushed into the hollow handle. Projections 63,56 thereby slide through longitudinal slots 57 in the inner sleeve. Simultaneously, spring 52 is then compressed. Consequently, the bellows is brought under pressure by the spring but cannot be compressed itself, since the bellows is filled and conduit 5 is closed. After the above described steps, the position of use shown in FIG. 3 is reached.

For supplying paint or the like from the bellows to the bristles, only conduit 5 need be opened briefly. To that end, it is only necessary to depress the projection 62 with the finger, since the thrust for supplying the paint or the like is provided by spring 52. Thus, in this embodiment, projection 62 has the dual purpose of serving as a detent means for the head 12 and as an operating means for opening the conduit 5. Of course, these two functions may be separated, as appears in FIGS. 7 and 8.

Various constructions are conceivable for closing or opening conduit 5. For instance, a butterfly valve operated by projection 62 or a suitable gate valve could be used. Advantageously, and in accordance with the present invention, a construction is used in which conduit 5 comprises at least a flexible part that can be closed. Embodiments are shown in FIGS. 5 and 6. These figures also show the earlier described alternative lock of skirt 58 of cover 53 by means of an internal shoulder 70, which falls behind projections 71 of one or more resilient tongues extending beyond the skirt of the cover. The free ends of the tongues form operating members 72.

As illustrated in FIGS. 5, 6, bellows 51 has an integrally moulded stub 73 at its bottom by means of which the bellows is secured in a partition 74 and on which a flexible section 75 of conduit 5 is mounted. At some distance from stub 73, there are positioned compressing members for conduit section 75. In the embodiment shown in FIG. 6, there is provided a fixed stop 76 having a sharp edge 77 and a movable projection 78 also having a sharp edge 79. The sharp edges 77, 79 are adapted to jointly squeeze the flexible conduit 75. To that end, a spring 80 acts on projection 78.

In the example shown, the fixed stop comprises a partition in the sleeve, said partition containing an opening 81 with a beveled edge on one side. Conduit 75 is passed through opening 81. Directly underneath (or above) the partition, there is arranged a platelike member slidable along the partition, and having a similar opening 82 with a beveled edge. The two beveled edges lie opposite one another. The platelike member extends outwardly though an opening in the hollow handle, as shown, and thereby forms the operating projection.

In the example shown in FIG. 5, the fixed stop of FIG. 6 is likewise designed as an operating projection 83, similarly to projection 78. In that case, operation from two sides is possible and the extent to which conduit 75 is opened can be controlled by depressing one or two projections.

In the example of FIG. 5, conduit 5 is made of flexible material along its entire length. In the example of FIG. 6, the flexible compressible section 75 links up with a rigid section 85.

In these embodiments, head 12 terminates underneath the operating projection(s) in the normal operating position. Projections 78 and 83 may be designed in a similar manner to the tongue-shaped members 61.

FIG. 6 further shows an additional modification, in which the end of conduit 5 extending into the bristles is closed by pinching or by a plug 86, which may or may not be detachable.

The opening(s) 87 in conduit 5 necessary for the supply of paint or the like are disposed in the cylindrical wall of the conduit. This has the advantage of providing a better distribution of the paint in the bristles 3.

According to a further modification shown in FIG. 6, the head is fitted with a tubular guide 88 for the conduit 85. The guide may be short or may be long as shown. In the latter case, the guide should have openings corresponding with openings 87. The guide 88 and the conduit 85 are rotatable relative to each other so that the openings can be brought in alignment, to a lesser or greater extent, by rotation of portion 88 relative to conduit 85. Thus, the sizes of the effective passages can be tuned to the viscosity of the material to be processed.

Portion BB an advantageously be connected to the head, which may then be rotatable relative to the handle. This also offers the possibility of providing one or more marks (not shown) exteriorly of the head and the sleeve SO as to indicate the position of portion 88 relative to opening 87.

It is further noted that the outlet openings of the tubular conduit can be rendered controllable in a different manner with the same effect. For instance, a conical screw or the like could be used instead of plug 86.

The head 12 of a brush according to the present invention can advantageously be made exchangeable, so that, e.g., a round or a flat or a small or a large brush can be formed as desired.

The bellows of the brush according to the present invention can be made of a resilient synthetic plastic material, such as polyamide or other suitable materials, for example, polypropylene.

As regards the sliding movement of the head 12 on the lower part of the hollow handle, it is observed that a simple up and down movement may be used. Such movement preferably is guided by, for example, one or more grooves in the hollow part of the head 12 cooperating with one or more projections or ribs on the handle. Other means for guiding the movement of the head on the handle may be provided.

Preferably, the guiding means are designed in such a manner that the head, when sliding up or down over the handle simultaneously makes a rotating movement, so that a spiral movement results. Thus, the user may simply rotate the head in the right direction with respect to the handle in order to bring the head into the use position or the filling position.

Figure 7:
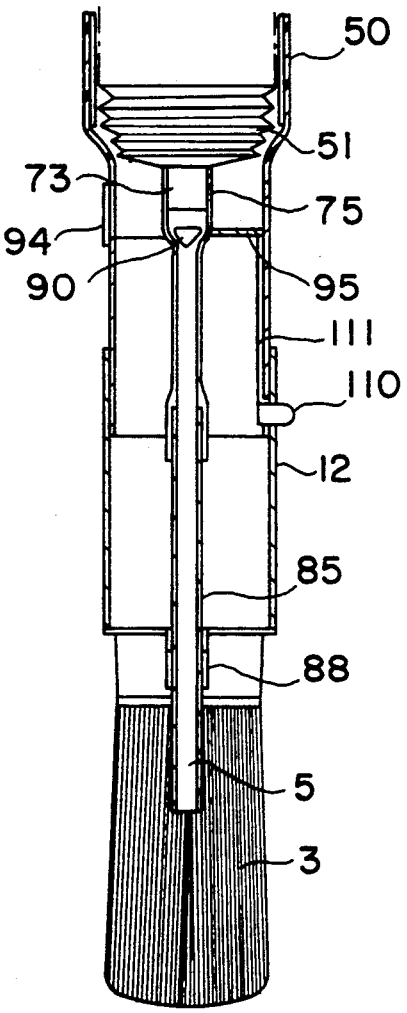
FIGS. 7–9 diagrammatically illustrate an embodiment of a detail of the inventive brush.
Figure 8:
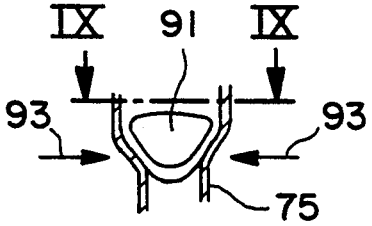
Figure 9:
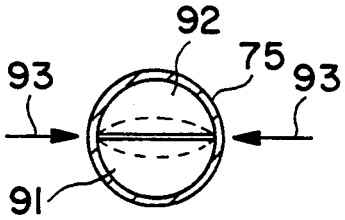

FIG. 7 shows an embodiment of a brush according to the present invention in which the conduit 5 has a rigid end portion 85 extending through a tubular guide 88 formed in the head 12 into the bundle of bristles 3. The rigid portion is connected to the stub 73 of the bellows 51 through a flexible tube section 75 as in FIG. 6. Inside the flexible tube section, a fish-mouth valve 90 is provided which is shown in more detail in FIGS. 8 and 9. The fish-mouth valve 90 has two cheeks 91 and 92 each having a free upper edge 101 and 102 respectively, extending substantially radially in the flexible tube section. Each cheek has a roughly triangular shape and the other edges are moulded into or in another manner sealingly connected to the inner surface of the flexible tube section. The upper edges of the cheeks normally sealingly rest against each other, thereby preventing liquid flowing from the chamber 51 to the bristles 3. However, when a pressure is exerted in the direction of arrows 93, the upper edges of the cheeks will become curved as shown in phantom lines 101' and 102' in FIG. 9 and provide a passage for paint or the like.

As shown in FIG. 7, an operating lip or button 94 is provided which may be used to push the fish-mouth valve 90 against a fixed support 95 in order to open the passage.

The button 94 may be a resilient lip of an insert of which support 95 may also be a part. Further, FIG. 7 shows a detent means 110 for the head 12. The detent means in this embodiment comprises at least one projection resiliently connected by means of a strip 111 within the lower part of the hollow handle and protruding through an opening in the hollow handle and a corresponding opening in the head 12. The detent means can also be part of the insert.

Alternatively, the closure means may comprise a valve seat formed by a circular shoulder in the flexible tube section against which shoulder a valve body lies. Squeezing the flexible tube will result in an oval shape of the shoulder, thus providing a passage between the shoulder and the valve body. The valve body may be a simple ball or a similarly shaped body.

Figure 10:
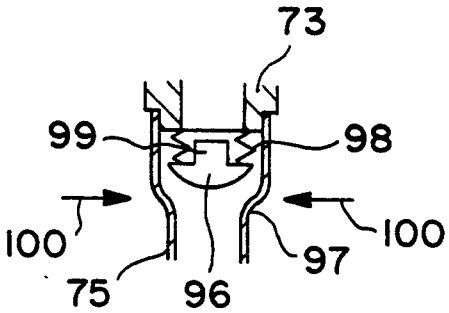
FIG. 10 illustrates a modification of the embodiment of FIGS. 7–9.

In the embodiment shown in FIG. 10, the valve body is a mushroom-shaped body 96, which is positioned upside down in the flexible tube section 75, so that the head of the upside down mushroom rests on a shoulder 97 in the flexible tube section. The valve body is kept in its sealing position by means of a spiral spring 98 positioned between the head of the mushroom and the lower end of the stub 73 of the bellows 51. The spring lies around the shaft 99 of the mushroom, which keeps the spring from moving sideways. When the flexible tube section is squeezed as indicated by arrows 100, the shoulder 97 will get an oval shape and thereby the valve body will be pushed upwards, thus providing a passage between the valve body and the shoulder. The squeezing may be effected, for example, in the manner shown in FIG. 7. If the squeezing is terminated, the shoulder will resume its circular shape and the valve body will be sealingly urged against the shoulder by the spring 98.

The foregoing is intended as illustrative of the present invention but not limiting. Numerous variations and modifications may be effected without departing from the true spirit and scope of the invention.

What is claimed is:

1. A brush comprising a bundle of bristles connected to a handle;

a bellow reservoir in the handle to be filled with liquid material, said handle forming a cylindrical casing in which said bellows reservoir is placed;

means for filling said reservoir including a tubular conduit connected to one end of the bellows reservoir and extending into a liquid conductive relationship in the bundle of bristles;

pressurizing means in the handle on the other end of the bellows reservoir, said pressurizing means including a support on the end of the reservoir and a compression spring, the compression spring extending between the support and a cover of the end of the cylindrical casing, and, in the position of use, exerting a continuous compressive force on the bellows reservoir;

controllable closure means for preventing said liquid material from flowing freely from the reservoir to said bristles;

an inner sleeve connected to said cover of said cylindrical casing and extending in the cylindrical casing, said inner sleeve having at least one longitudinal slot which is closed near the end proximal to the bundle of bristles, said longitudinal slot receiving at least one radial protrusion of the support;

wherein the cover is releasably locked relative to the casing; and wherein said bundle of bristles is set into a head mounted for movement along the lower end of said handle, thereby rendering said conduit and said bundle in use movable relative to each other between a first or use position, in which an end of said conduit remote from said reservoir is situated within said bundle of bristles and in which the position of said head relative to said handle is fixable by detent means, and a second or filling position, in which the end of said conduit remote from said reservoir extends through and beyond said bundle of bristles.

2. A brush as claimed in claim 1, wherein the cover has a skirt falling around the casing, the skirt having at least one window-like cut-out, which is adapted to receive a protrusion resiliently connected to the casing.

3. A brush as claimed in claim 1 wherein the cover has a skirt which falls around the casing and has a shoulder on its inside that is adapted to catch behind at least one protrusion resiliently connected to the casing.

4. A brush as claimed in claim 2 or 3, wherein the resiliently connected protrusion is a projection of a lip cut out in the casing wall, said lip having an operating end extending beyond the skirt.

* * * * *